US005302186A

United States Patent [19]

Field et al.

[11] Patent Number: 5,302,186

[45] Date of Patent: Apr. 12, 1994

[54] PELLETISATION PROCESS

[75] Inventors: John R. Field; Anthony P. Allen, both of West Yorkshire, England

[73] Assignee: Allied Colloids Limited, England

[21] Appl. No.: 941,039

[22] PCT Filed: Apr. 23, 1991

[86] PCT No.: PCT/GB91/00645

§ 371 Date: Oct. 8, 1992

§ 102(e) Date: Oct. 8, 1992

[87] PCT Pub. No.: WO91/16463

PCT Pub. Date: Oct. 31, 1991

[30] Foreign Application Priority Data

Apr. 26, 1990 [GB] United Kingdom ..... 9009404

[51] Int. Cl.[5] ..... C22B 1/24; C22B 1/242

[52] U.S. Cl. ..... 75/771; 75/320

[58] Field of Search ..... 75/320-322, 75/771-773

[56] References Cited

U.S. PATENT DOCUMENTS

| | | | |
|---|---|---|---|
| 3,660,073 | 5/1972 | Youngs | 75/771 |
| 3,966,427 | 6/1976 | Herment | 75/771 |
| 4,659,374 | 4/1987 | Alanko | 75/771 |

*Primary Examiner*—Peter D. Rosenberg

*Attorney, Agent, or Firm*—Dickstein, Shapiro & Morin

[57] ABSTRACT

Pellets of iron ore or other water insoluble particulate material are made from a mixture of the particulate material, moisture and a pelletizing binder by forming moist green pellets, a water displacing additive is applied to the surface of these pellets after they are substantially wholly formed, and the pellets are then dried. The preferred water displacing additive is a solution of a silicone in an organic solvent.

10 Claims, No Drawings

PELLETISATION PROCESS

This invention relates to surface treatment of mineral ore pellets.

Pelletisation of mineral ores and other water insoluble particulate material is well known and provides a convenient way of converting fine particulates into a more easily handleable form.

Pelletisation of the particulate material involves the use of a binder and moisture. The binder can be an inorganic binder such as a clay type material, for example bentonite, or it can be an organic polymeric material for example, carboxymethyl cellulose or water soluble synthetic polymer.

The amount of moisture in such pellets is critical and this has been studied and the theory described by Newitt and Conway-Jones in Trans Instn Chem. Engrs., pages 422 to 442, 36 1958. They describe three states occuring in water-particle systems in the pelletisation process. Firstly, the Pendular state in which water is present at the point of grain contact only and the surface tension holds the particles together. Secondly, the Funicular state where some of the internal voids of the pellet are fully occupied by water. Thirdly the capillary state where all of the internal voids of the pellet are filled but the surface is not covered by a coherent film.

In practice the capillary state is the commercial optimum and this corresponds to a moisture content overall in the pellets generally of from 7 to 15%. However, it can be difficult to produce the pellets in the capillary state with high internal moisture, but without having too much surface moisture. If the water content is too high then not only are the voids of the pellets filled with water but there is also a significant amount of water on the outside of the pellets. There are several adverse side effects of this, including a reduction in the green strength of the pellet, attraction of fines which lead to subsequent higher dust levels, and low permeability of a bed of the pellets during subsequent treatment.

In the present invention it is intended to provide a way of keeping the moisture levels within the pellet high enough to produce substantially the optimum capillary state with the high green strength which that produces, while avoiding or reducing surface moisture problems.

In the process of the present invention, pellets of water insoluble particulate material are made from a mixture of the particulate material, moisture and pelletising binder by forming moist green pellets and then drying the green pellets characterised in that at least one water displacing additive is applied to the surface of the moist green pellets after they are substantially wholly formed and before they are dried.

The particulate material can be coal or other particulate water insoluble material, but preferably a mineral ore, for example zinc ore or preferably an iron ore, normally a haematite, magnetite or taconite. The particle size of the particulate material is generally substantially all below 300 μm and preferably below 200 μm and most preferably below 100 μm.

The binder may be an inorganic binder such as bentonite or other clays, lignosulphonates, ferrous sulphate, asphalt, or organic material which may be natural or modified natural materials for example polymers of starch, sodium carboxymethyl cellulose and various non-ionic, anionic or cationic synthetic polymers. As examples of synthetic polymers, water soluble acrylic polymer and other polymers as defined in EP 225171, EP 288150 and EP 203855 are suitable. Mixtures of for example synthetic polymer and bentonite are also suitable binders.

Preferred binders are water-soluble polymers of 5–30% acrylic acid with 95–70% acrylamide having an intrinsic viscosity of about 3 to 15 dl/g, introduced as fine powder, for example as described in EP 225171. Often the binder includes sodium carbonate or other additive, for example in EP 225171.

Moisture is present in the particulate mixture before addition of the binder and more water can be added after or during addition of the binder. If the moisture content of the particulate mixture is already sufficiently high then no further water need be added. The preferred amount of water in the particulate mixture is generally from 7 to 15%, usually 8 to 12% by weight.

The pellets which are to be treated by the process of the invention can be made by any pelletising technique. The usual techniques include the use of either a balling drum or disc pelletiser.

The moisture displacing additive can be added either on completion of pelletising or when the pellets are substantially formed. The purpose of the moisture displacing additive is to deal with residual surface water without affecting the internal bonding and internal capillary state of the pellets. Therefore at least most of the internal capillary structure of the pellet must have been formed before the moisture displacing additive is added.

Therefore, addition of a moisture displacing additive into the original pelletising mix may not be satisfactory because the additive may interfere with the internal bonding and the internal capillary structure of the pellet and this may result in an adverse effect on the properties of the pellet. As explained below, the additive is often a material that changes the surface tension of moist surfaces and this could have a serious adverse effect on the capillary structure and bonding in the pellets if introduced into the original mix or too early in the pelletising process.

When the pellets are made in a pelletising drum, the additive may be applied as they leave the drum or subsequently and the pellets should be agitated after application of the additive. Application can be through spray outlets from the drum or by using lick rollers at transfer points. At these positions in the process the pellets are substantially fully formed and so application of the additive through the spray outlets or lick rollers results in a surface coating on the pellets.

If the additive is applied after pelletising is complete (and this is often preferred) then preferably there is some further movement of the pellets in order to promote a more even distribution of the additive around the surface of the pellets. This mixing can be provided for example by further rotation in a drum, by agitation, or by the agitation produced by movement of the pellets, for example by passage along a conveyor.

The water displacing additive may function as a surface tension modifier or as a water absorbent. Preferably the additive is a modifier of the critical surface tension (CST) of the surface so that the critical surface tension of the surface of the pellet is lowered so that it is lower than the surface tension of the water, and so water is repelled from the surface and is more readily lost from the pellet surface either by evaporation, or other drying means.

Preferably, besides having a moisture displacement effect, the additive has the additional effect of lubricating the pellets. Therefore, the reduction in stickiness between the pellets and consequent improved flow is a two-fold effect resulting from removal of excess moisture on the pellet surface and lubrication. Surface lubrication between the particles has the additional advantage that during movement and drying of pellets, for example by agitation, particles of mineral ore are less likely to be lost from the surface of a pellet and so the dust levels are minimised. It has been found that the lubricating effect reduces loss of for example, magnetite ($Fe_3O_4$) particles, and so the iron obtained from the mineral ore is maximised.

The additive must be substantially non-aqueous. It can be supplied in the form of a dry powder or as a liquid. The liquid should be substantially anhydrous and is preferably wholly anhydrous for example, preferably the additive contains less than 10% and most preferably less than 2% water. If it is supplied as a liquid, then the liquid can consist of a material which would give the desired effect or can be a solution or a dispersion of the additive in solvent. If the additive is used in solvent, preferably the solvent also has some effect as a moisture displacing additive.

If a solvent is used, then it should be non-flammable and sufficiently high boiling that preferably, it only volatilises in for instance the drying and initial firing stage of pelletisation in order that it does not produce environmentally problematic vapours in the working environment. Hydrocarbon solvents are suitable as are, for example terpenes. Other suitable examples include higher alcohols such as cetyl alcohol, higher ketones such as methyl, ethyl or dimethylketone or chlorinated hydrocarbons.

Examples of suitable additives which are effective due to surface tension modifying effect are pale oils, spindle oils, silicones and flurocarbons (although this is environmentally unfavourable) pyridinium compounds, organometallic complexes, waxes and wax-metal emulsions and resin based finishes. A particularly preferred example is WD 40(TM) which is a silicone composition.

Silicone is particularly preferred because it provides the preferred additional lubricating effect, but other materials can be used.

The amount of moisture reducing additive which must be applied to the pellets of particulate material varies with respect to the particular additive and its degree of activity and can be determined by routine experiment.

The second type of water displacing additive which may be used are effective due to their water absorbing capacity. The water absorbing compound may be, for example, a water swellable clay such as bentonite which can be dusted onto the surface of the pellets, or may be a polymeric absorbent. The polymeric absorbent may be in a form of a dry particle and may be dusted onto the pellets in the same way as the clay type water absorbents, or may be provided in a liquid form either as a dispersion or an emulsion.

If the polymer is to be provided as a liquid, in a solvent, the solvents discussed above may be used. The water absorbent polymer is a water swellable polymer and is usually a crosslinked polymer. It may be an anionic, cationic or non-ionic synthetic polymer or a natural or modified natural polymer for example starches, celluloses or gums.

Suitable polymers are as described in EP 0195550, EP 0277017 and EP 0277018.

After application of the additive, the green pellets are subjected to conventional drying and firing techniques. For example, after application of the additive, the pellets are dried typically at temperatures of from 300 to 700° C. in order to remove some of the surface moisture.

Before the resultant green pellets can be used, e.g. for the production of iron or other mineral, they need to be fired, generally at temperatures reaching above 1000° C., for instance up to 1200° C. For this purpose they can be introduced into a kiln or other firing apparatus and fired in conventional manner. It is desirable to be able to introduce them into this furnace at the highest possible inlet temperature. The inlet temperature is significant because in the capillary stage the green strength of the pellets is maximised so that the risk of spalling (explosion of the pellets) is reduced and pellets can be placed into the kiln at high inlet temperatures.

The following are some examples demonstrating the invention.

EXAMPLE

Firstly, as a control, 150.0 g of freshly prepared pellets of iron ore having dimensions of approximately 5.6 mm and moisture content approximately 10.5%, were placed in a metal tray and agitated by hand for 90 seconds. The pellets were then allowed to stand and the time was designated T=0. 10.0 g of pellets were removed and added to a pre-dried 11.0 centimeter filter paper (pre-dried) attached to a petri dish and agitated for 60 seconds. The pellets were then discarded and the filter paper reweighed. Any excess weight is therefore, moisture and dry iron ore lost from the pellets (in this case magnetite). The filter paper was then dried at 105° C. and was reweighed. From this the weight of dried magnetite was calculated and the original weight of moisture picked up from the pellets was also determined.

This process was repeated at regular intervals from T=0 up to T=60 mins using stationary pellets from the tray.

In a second test, in accordance with the invention, the above process was repeated using a fresh batch of 150 g pellets that had been sprayed with 1.0 g of WD40 (this is a Trademark of a product obtainable from WD-40 Company Limited of Milton Keynes). The product constitutes a silicone polymer in an organic solvent.

The results are tabulated below. Table 1 shows the results of the control experiment and table 2 shows the results of the tests according to the invention.

TABLE 1

| TIME AFTER AGITATION/MINS | MOISTURE LOSS/g | MAGNETITE (DRY) LOSS/g | TOTAL WEIGHT LOSS/g | % WATER IN WEIGHT LOSS |
|---|---|---|---|---|
| 0 | 0.049 | 0.036 | 0.085 | 57.6 |
| 5 | 0.043 | 0.033 | 0.076 | 56.6 |
| 15 | 0.030 | 0.024 | 0.054 | 55.6 |
| 35 | 0.010 | 0.021 | 0.031 | 32.3 |
| 60 | 0.006 | 0.026 | 0.032 | 18.8 |

TABLE 2

| TIME AFTER AGITATION/MINS | MOISTURE LOSS/g | MAGNETITE (DRY) LOSS/g | TOTAL WEIGHT LOSS/g | % WATER IN WEIGHT LOSS |
|---|---|---|---|---|
| 0 | 0.063 | 0.027 | 0.090 | 70.0 |
| 6 | 0.053 | 0.024 | 0.077 | 68.8 |
| 13 | 0.050 | 0.025 | 0.075 | 66.7 |

TABLE 2-continued

| TIME AFTER AGITATION/MINS | MOISTURE LOSS/g | MAGNETITE (DRY) LOSS/g | TOTAL WEIGHT LOSS/g | % WATER IN WEIGHT LOSS |
|---|---|---|---|---|
| 25 | 0.038 | 0.016 | 0.054 | 70.4 |
| 45 | 0.022 | 0.011 | 0.033 | 66.7 |
| 60 | 0.010 | 0.011 | 0.021 | 47.6 |

These examples show the increased amount and increased rate of moisture loss from the pellets which have been treated with the moisture displacement additive compared to the results in Table i where there is no moisture displacement additive. In addition, the examples show that the amount of dry particles lost is lower following application of the displacement additive and this gives the additional benefit that dusting levels of pellets after treatment with the water displacement additive is minimised.

We claim:

1. A process in which pellets of water insoluble particulate material are made by providing a mixture of the particulate material, moisture and a pelletising binder, forming moist green pellets by pelletising this mixture by a balling drum or disk pelletiser, applying a non-aqueous water displacing additive to the surface of the moist green pellets after they are substantially wholly formed and thereby displacing water from the surface of the pellets, and then drying the green pellets.

2. A process according to claim 1 in which the particulate water insoluble material is a mineral ore in which substantially all the particles are below 300 μm in size.

3. A process according to claim 1 in which the binder comprises a water soluble organic polymeric material or bentonite or a mixture thereof.

4. A process according to claim 1 in which the binder comprises a water soluble polymer of 5 to 30% acrylic acid with 95 to 70% acrylamide and having intrinsic viscosity of 3 to 15 dl/g alone or, mixed with bentonite.

5. A process according to claim 1 in which the binder also includes sodium carbonate.

6. A process according to claim 1 in which the pellets are made in a pelletising drum and the moisture displacing additive is applied to the pellets as they leave the drum or subsequently and the pellets are agitated after application of the moisture displacing additive.

7. A process according to claim 1 in which the water displacing additive is a material that reduces the critical surface tension of the surface of the pellets to a value that is lower than the surface tension of water.

8. A process according to claim 1 in which the water displacing additive is a lubricant for the pellets.

9. A process according to claim 1 in which the water displacing additive comprises an organic solvent or a silicone or a mixture thereof and contains less than 10% water.

10. A process according to claim 1 in which, after application of the water displacing additive, the pellets are dried at from 300 to 700° C. and are then fired at a temperature above 1000° C.

* * * * *